United States Patent [19]

Fricke

[11] 4,373,428

[45] Feb. 15, 1983

[54] GLIDE SHOE OF A HYDRAULIC PISTON MACHINE

[75] Inventor: Hans J. Fricke, Stuttgart, Fed. Rep. of Germany

[73] Assignee: Robert Bosch GmbH, Stuttgart, Fed. Rep. of Germany

[21] Appl. No.: 219,385

[22] Filed: Dec. 22, 1980

Related U.S. Application Data

[63] Continuation of Ser. No. 936,603, Aug. 23, 1978, abandoned.

[30] Foreign Application Priority Data

Nov. 11, 1977 [DE] Fed. Rep. of Germany ..... 2750490

[51] Int. Cl.[3] ..... F01B 31/10

[52] U.S. Cl. ..... 92/159; 91/488; 92/DIG. 2

[58] Field of Search ..... 92/159, 158, 160, 157, 92/DIG. 1, DIG. 2, 86.5; 91/488

[56] References Cited

U.S. PATENT DOCUMENTS

| | | | |
|---|---|---|---|
| 3,223,046 | 12/1965 | Eickmann | 91/488 |
| 3,395,948 | 8/1968 | Andrews | 91/488 |
| 3,628,425 | 12/1971 | Morita et al. | 91/488 |
| 3,695,146 | 10/1972 | Prshonsky | 91/488 |
| 3,948,149 | 4/1976 | Fricke et al. | 91/488 |
| 3,951,047 | 4/1976 | Eickmann | 91/488 |
| 3,978,772 | 9/1976 | Miyao et al. | 91/488 |

FOREIGN PATENT DOCUMENTS

| | | | |
|---|---|---|---|
| 983310 | 2/1965 | United Kingdom | 91/488 |

*Primary Examiner*—Paul E. Maslousky
*Attorney, Agent, or Firm*—Michael J. Striker

[57] ABSTRACT

A glide shoe of a hydraulic piston machine has a glide face which is in gliding contact with a gliding surface of a piston-reciprocating element. The glide shoe has a bore which communicates with an interior of a housing of the machine and extends toward the glide face so that a working medium which flows through the bore causes build-up of a hydrostatic pressure between the bore and the glide surface of the piston-reciprocating element. The glide face is continuous and is interrupted only by recess means which occupies not more than a relatively small portion of the glide face so that a relatively high hydrodynamic pressure can build up between the remainder portion of the glide face and the glide surface of the piston-reciprocating element during working movement of the glide shoe relative to the piston-reciprocating element.

16 Claims, 18 Drawing Figures

GLIDE SHOE OF A HYDRAULIC PISTON MACHINE

This is a continuation of application Ser. No. 936,603, filed Aug. 23, 1978 now abandoned.

BACKGROUND OF THE INVENTION

The present invention relates to a glide shoe of a hydraulic piston machine.

Glide shoes of hydraulic piston machines are known in the art. A known glide shoe has a bore which communicates with an interior of a cylinder in which a piston reciprocates and extends toward a glide face of the glide shoe. A working medium flows through the bore from the interior of the cylinder toward the glide face of the glide shoe and causes build-up of a high hydrostatic pressure between the bore and a gliding surface of a piston-reciprocating element which is in gliding contact with the glide face of the glide shoe. At the same time, the known glide shoe is provided with a large recess on the glide face thereof. In such a construction only a relatively low hydrodynamic pressure can build up between the small remainder portion of the glide face of the glide shoe and the glide surface of the piston-reciprocating element when the glide shoe moves relative to the latter. Thereby a hydrodynamic relief of the glide shoe is insufficient. However, the hydrodynamic relief must be maintained at the highest possible level during operation of the machine.

SUMMARY OF THE INVENTION

Accordingly, it is an object of the present invention to provide a glide shoe of a hydraulic piston machine, which avoids the disadvantages of the prior art.

More particularly, it is an object of the present invention to provide a glide shoe of a hydraulic piston machine in which a hydrodynamic pressure between a glide face thereof and a piston-reciprocating element is increased so that relief of the glide shoe is substantially improved, as compared with the known glide shoes.

In keeping with these objects, and with others which will become apparent hereinafter, one feature of the present invention resides, briefly stated, in a glide shoe having a bore which communicates with an interior of a machine housing and is open at a glide face of the glide shoe so that a working medium flows through the bore and causes a build-up of hydrostatic pressure between the bore and a glide surface of a piston-reciprocating element, wherein the glide face of the glide shoe is continuous and is interrupted only by recess means which occupies not more than a relatively small portion of the glide face of the glide shoe. In such a construction a relatively high hydrodynamic pressure can build up between the remainder portion of the glide face of the glide shoe and the glide surface of the piston-reciprocating element during working movement of the glide shoe relative to the piston-reciprocating element.

In accordance with another feature of the present invention, the recess means may be formed by an outlet of the bore extending through the glide shoe. The outlet may be located centrally of the glide face or may be offset relative to an axis of the glide face in the direction of movement of the glide shoe relative to the piston-reciprocating element.

Still another feature of the present invention is that the recess means may be formed as one or several narrow grooves. The bore or several bores which are provided in the glide shoe may be offset relative to the grooves or may be open into the latter. The grooves may extend in the direction of movement of the glide shoe relative to the piston-reciprocating element or may be arranged in inclined relationship to this direction.

A further feature of the present invention is that the groove which forms the recess may have a closed contour. This contour may be rectangular, square, rhombic, circular or the like. The bores of the glide shoe may be open into the thus-shaped groove.

An additional feature of the present invention is that the recess means may include two grooves which extend substantially in the direction of movement of the glide shoe relative to the piston-reciprocating element, and may be connected by a third groove which extends in a direction transverse to the direction of movement.

Still an additional important feature of the present invention is that the recess means may occupy an area which is smaller than 25% preferably smaller than 20% of the area of the glide face of the glide shoe.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
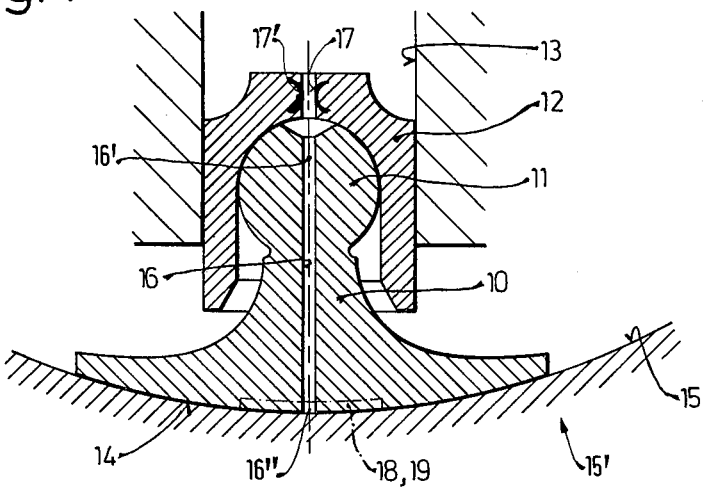
FIG. 1 is a view showing a longitudinal section of a glide shoe in accordance with the present invention, which is assembled with a piston.

Discussing first FIG. 1, it will be seen that reference numeral 10 identifies a glide shoe which has a spherical head 11. The latter is received in a bore 13 of a piston 12 in sealing gliding contact with the latter. The glide shoe 10 has a glide face 14 which is in gliding contact with a gliding surface 15 of a piston-reciprocating element 15'.

A longitudinal bore 16 extends through the glide shoe 10. It communicates with a bore 17 of the piston 12 and is open at the glide face 14, of the glide shoe 10. The bores 16 and 17 are provided with throttling means 16' and 17', respectively, or are formed as throttling bores. A small amount of a pressure medium flows through the bores 16 and 17 from the interior of a cylinder toward the glide face and causes build-up of a hydrostatic pressure between the bore 16 and the glide surface 15 of the piston-reciprocating element 15'. A hydrostatic field which is formed by the afore-mentioned hydrostatic pressure is shown in dotted lines in FIG. 2.

Figure 2:
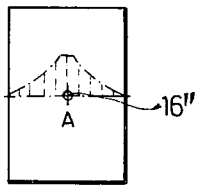
FIGS. 2–18 are views showing a glide face of the glide shoe in accordance with several different embodiments of the present invention.
Figure 3:
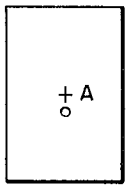

As shown in FIGS. 2 and 3, the glide face 14 of the glide shoe 10 is continuous and is interrupted only by recess means which are formed by an outlet 16'' of the bore 16. The outlet 16'' occupies only a small portion of the glide face 14 so that a substantially large portion of the glide face 14 remains uninterrupted. For this reason, when relative speed between the glide shoe 10 and the piston-reciprocating element 15' increases, as increased hydrodynamic pressure builds up between the larger remainder portion of the glide face 14 of the glide shoe 10 and the glide surface 15 of the piston-reciprocating element 15'.

The outlet 16" of the bore 16 may be located centrally of the glide face 14 of the glide shoe 10 as shown particularly in FIG. 2. On the other hand, the outlet 16" of the bore 16 may be offset relative to a center A of the glide face 14 of the glide shoe 10 in the longitudinal direction, e.g., in the direction of movement of the glide shoe 10 relative to the piston-reciprocating element 15', as shown particularly in FIG. 3. In the latter construction, the offset location of the outlet 16" of the bore 16 provides for compensation of an eccentric application of force during operation of the machine.

Figure 4:
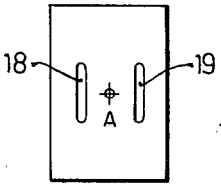

As shown in FIG. 4, the recess means provided on the glide face 14 of the glide shoe 10 may include two grooves 18 and 19 which extend in a longitudinal direction of the glide face 14 and are spaced from one another in the transverse direction. The grooves 18 and 19 are rectilinear and located in the middle between longitudinal edges of the glide face 14 and the outlet 16" of the bore 16. In this construction the hydrostatic pressure field is laterally limited by the grooves. The grooves 18 and 19 have a small depth, as shown in dotted lines in FIG. 1. The grooves 18 and 19 which are shown in FIG. 4 are located centrally of the glide face 14 of the glide shoe 10. It is also possible that the grooves are offset relative to the center A of the glide face 14 in the longitudinal direction, as shown particularly in FIG. 5.

Figure 5:
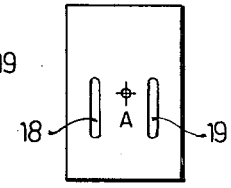
Figure 6:
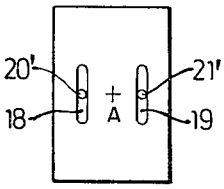
Figure 7:
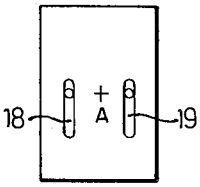
Figure 18:
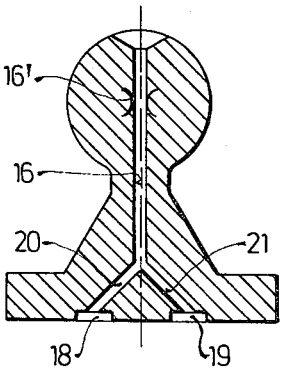

Whereas the grooves 18 and 19 shown in FIGS. 4 and 5 do not communicate with the bore 16, FIGS. 6 and 7 show the glide shoe in which two bores are provided and the outlets of each of these bores open into a respective one of the grooves 18 and 19. The bores are identified by reference numerals 20 and 21 and the outlets of the bores are identified by reference numerals 20' and 21'. Such a construction is also shown in FIG. 18 which is a section of the glide shoe 10 in accordance with this embodiment of the present invention. When the glide shoe 10 is so constructed, the hydrostatic pressure field is exactly limited in the transverse direction. The grooves 18 and 19 shown in FIG. 6 are located centrally of the glide face 14 of the glide shoe 10 in the longitudinal direction, whereas the grooves shown in FIG. 7 are offset relative to the center A of the glide face in the longitudinal direction.

The grooves which are shown in the aforementioned figures or will be discussed later on have a rectilinear contour. However, it is to be understood that the grooves may also have a curved contour.

Figure 8:
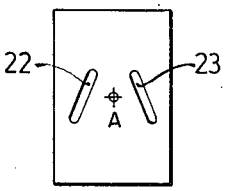
Figure 9:
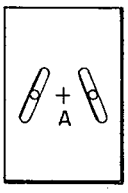

In the glide shoe in accordance with the embodiments shown in FIGS. 8 and 9, two bores which are identified by reference numerals 22 and 23 are inclined relative to one another so as to include an acute angle. In the glide shoe shown in FIG. 8, the outlet 16" of the bore 16 is located in the central region between the grooves 22 and 23. In the glide shoe shown in FIG. 9, the glide shoe 10 has two bores the outlet of each of which is open into a respective one of the grooves 22 and 23. Such a construction guarantees compensation for an eccentric application of a force to the glide shoe.

Figure 10:
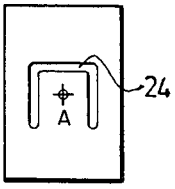
Figure 11:
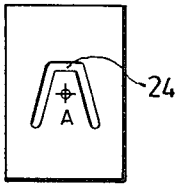
Figure 12:
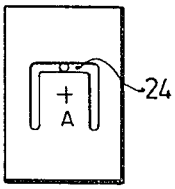
Figure 13:
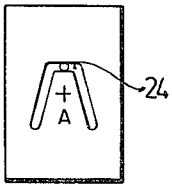
Figure 14:
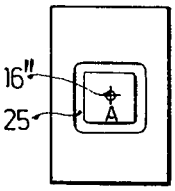

The glide shoes 10 which are shown in FIGS. 10–13 are again provided with two grooves which extend substantially in the longitudinal direction. However, in the glide shoes shown in these Figures, the two grooves are connected with one another by means of an additional groove 24 which extends in a direction substantially transverse to the longitudinal direction. The longitudinal grooves shown in FIGS. 10 and 12 are parallel to one another and extend exactly in the longitudinal direction of the glide face 14. The longitudinal grooves shown in FIGS. 11 and 13 are inclined relative to one another so as to include an acute angle. As shown in FIGS. 10 and 11, the outlet 16" of the bore 16 of the glide shoe is located in the central region between the grooves, whereas the outlets of the bores in the glide shoes shown in FIGS. 12 and 13 are open into the transverse groove 24. The longitudinal grooves and the connecting e.g. transverse groove 24 together form a composite groove which has a U-shaped or A-shaped contour. In such a construction the hydrostatic pressure field is further limited, and the supply of the working medium is further improved. By selection of a position of the bore or the grooves in the longitudinal direction an eccentrically applied force can be compensated.

Figure 15:
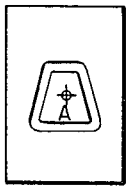

The glide shoes which are shown in FIGS. 14–17 are provided with a groove 25 which has a closed contour and includes two substantially longitudinal grooves and two transverse connecting grooves. The groove 25 shown in FIG. 14 has a rectangular or square contour, and the outlet 16" of the bore 16 is open at the center of gravity of the glide face 14. The grooves 25 shown in FIGS. 15 and 17 have a rhombic contour. The outlet 16" of the bore 16 in FIG. 15 is open at the center of gravity of the glide face, whereas the outlet 16" of the bore 16 shown in FIG. 17 in open into one of the transverse grooves.

Figure 16:
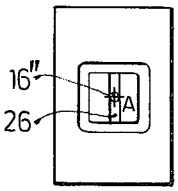
Figure 17:
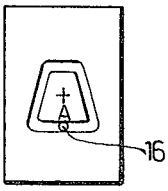

In the glide shoe 10 in accordance with the embodiment shown in FIG. 16, a further groove 26 is provided which extends in the longitudinal direction of the glide face 14, and connects two connecting grooves, e.g., transverse grooves with one another. The outlet 16" of the bore 16 is open into the further longitudinal groove 26. In this construction the hydrodynamic pressure field is completely limited.

A characteristic feature of the glide shoes in accordance with all embodiments of the present invention is that the recess means occupies not more than a relatively small portion of the glide face of the glide shoe. The glide face is practically continuous with the exception of the small portion occupied by the recess means. The latter has an area which is smaller than 25%, preferably smaller than 20% of the area of the glide face. Practically, the area occupied by the recess means is substantially smaller than the above-mentioned magnitude.

It will be understood that each of the elements described above, or two or more together, may also find a useful application in other types of constructions differing from the types described above.

While the invention has been illustrated and described as embodied in a glide shoe of a hydraulic machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. In a hydraulic piston machine of the type having a housing, a reciprocable piston in the housing, and a piston-reciprocating element having a glide surface and operating for reciprocating the piston, a combination comprising a glide shoe articulately connected to said piston and moving relative to the piston-reciprocating element in a first direction, said glide shoe having a glide face in sliding contact with said glide surface of the piston-reciprocating element, said glide shoe having at least one bore communicating with an interior of said housing and extending toward said glide face so that a working medium which flows through said bore causes build-up of a hydrostatic pressure between said bore and said glide surface of said piston-reciprocating element, said glide face being continuous and being interrupted only by recess means which occupies not more than a relatively small portion of said glide face and consists of an outlet of said bore which opens at said glide face of said glide shoe and, at least one groove which extends on said glide face of said glide shoe only in said first direction and is narrow in a second direction which is transverse to said first direction, so that the width of said groove measured in said second direction is considerably smaller than the length of the same measured in said first direction and no grooves extending in a direction other than said first direction are provided on said glide face, whereby a relatively high hydrodynamic pressure can build up between the remainder portion of said glide face of said glide shoe and said glide surface of said piston-reciprocating element during working movement of said glide shoe relative to the piston-reciprocating element.

2. A combination as defined in claim 1, wherein said groove extends parallel to said first direction.

3. A combination as defined in claim 1, wherein said glide face moves relative to said piston-reciprocating element in a first direction, said outlet of said bore is located centrally of said glide face of said glide shoe as considered in said first direction.

4. A combination as defined in claim 1, wherein said glide face has a center, said outlet of said bore being offset relative to said center in said first direction.

5. A combination as defined in claim 1, wherein said groove is rectilinear.

6. A combination as defined in claim 1, wherein said outlet of said bore of said glide shoe directly opens into said groove.

7. A combination as defined in claim 1, wherein said recess means further includes a second such groove which is parallel to said first-mentioned groove, so that only two grooves and no more grooves are provided on said glide face of said glide shoe.

8. A combination as defined in claim 1, wherein said glide shoe further has a second such bore, which is located adjacent to said first-mentioned bore and also has an outlet opening at said glide face of said slide shoe, said recess means further including a second such groove provided on said glide shoe and also extending in said first direction, said outlet of each of said bores being open into a respective one of said grooves.

9. A combination as defined in claim 8, wherein said outlets of said bores are offset relative to one another in a direction which is transverse to said first direction.

10. An arrangement as defined in claim 1, wherein said groove is located centrally of said glide face in said first direction.

11. An arrangement as defined in claim 1, wherein said glide face of said glide shoe has a center, said groove being offset relative to said center in said first direction.

12. An arrangement as defined in claim 1, wherein said glide face of said glide shoe has a predetermined area, said recess means having an area which is smaller than 25% of the area of said glide face.

13. An arrangement as defined in claim 1, wherein said recess means has an area which is smaller than 20% of the area of said glide face.

14. An arrangement as defined in claim 1, wherein said bore of said glide shoe is provided with a throttling means.

15. An arrangement as defined in claim 1, wherein said bore of said glide shoe is formed as a throttling bore.

16. A combination as defined in claim 1, wherein said outlet of said bore has a predetermined diameter, said groove having a transverse dimension corresponding to the diameter of said outlet of said bore.

* * * * *